United States Patent [19]

Arai et al.

[11] Patent Number: 4,523,551

[45] Date of Patent: Jun. 18, 1985

[54] VALVE ACTUATING DEVICE

[75] Inventors: Fuminao Arai, Chiryu; Hisashi Kodama, Nagoya; Takuro Ono, Chiryu, all of Japan

[73] Assignee: Aisin Seiki Kabushiki Kaisha, Kariya, Japan

[21] Appl. No.: 609,248

[22] Filed: May 11, 1984

[30] Foreign Application Priority Data

May 11, 1983 [JP] Japan ..... 58-070063[U]

[51] Int. Cl.[3] ..... F01L 1/18

[52] U.S. Cl. ..... 123/90.46; 123/90.36; 123/90.57

[58] Field of Search ..... 123/90.45, 90.46, 90.47, 123/90.57, 90.36

[56] References Cited

U.S. PATENT DOCUMENTS

| | | | |
|---|---|---|---|
| 2,071,051 | 2/1937 | Van Ranst | 123/90.46 |
| 2,764,141 | 9/1956 | Schoonover | 123/90.47 |
| 3,146,767 | 9/1964 | Dadd | 123/90.36 |
| 3,809,033 | 5/1974 | Cartledge | 123/90.46 |
| 4,192,263 | 3/1980 | Kitagawa et al. | 123/90.46 |

FOREIGN PATENT DOCUMENTS

| | | | |
|---|---|---|---|
| 1052798 | 1/1954 | France | 123/90.36 |
| 394777 | 7/1932 | United Kingdom | 123/90.46 |

*Primary Examiner*—Charles J. Myhre
*Assistant Examiner*—R. S. Bailey
*Attorney, Agent, or Firm*—Sughrue, Mion, Zinn, Macpeak and Seas

[57] ABSTRACT

A valve actuating device for an internal combustion engine having a cam and a valve stem comprises a rocker arm receiving a load from the cam at one end and actuating the valve stem at the other end thereof, a hydraulic valve lifter slidably disposed in the rocker arm, a hollow rocker arm shaft pivotally supporting the rocker arm, a first fluid supply passage formed in the rocker arm shaft, a second fluid supply passage formed in the rocker arm, and an air hole formed in an upper portion of the hollow rocker arm shaft.

3 Claims, 5 Drawing Figures

VALVE ACTUATING DEVICE

BACKGROUND OF THE INVENTION

1. Field of the Invention

This invention relate to valve actuating devices for internal combustion engines in general, and more particularly to a valve actuating device including a hydraulic valve lifter disposed in a rocker arm of a valve train of the internal combustion engines.

2. Description of the Prior Art

In the valve train of the internal combustion engines, predetermined valve clearances are generally provided in order to compensate for thermal expansion of various parts in the valve train. However, if the valve clearance is not properly maintained at a predetermined valve, undesirable noises are generated during the engine operation, and power losses are caused by blowing of raw gases. Hydraulic valve lifters have been used in the valve train so as to automatically take up the valve clearance in the valve train to thereby prevent the undesirable noises and the power losses.

An example of this type hydraulic valve lifter is disclosed in the Japanese published patent application No. 53-16112, wherein a hydraulic valve lifter is slidably disposed in the rocker arm which receives at one end a load from a cam and actuates at the other end thereof a valve stem. The valve lifter includes a plunger member which engages at one end with the valve stem or the cam and defines at the other end thereof a pressure chamber, a reservoir chamber formed in the rocker arm, and a check valve which allows the flow of a hydraulic fluid, such as lubricating oil of the engine, from the reservoir chamber to the pressure chamber. The reservoir chamber receives the oil from a source by means of both an oil supply passage formed in the rocker arm and an oil supply passage formed in a hollow portion of the rocker shaft. In the above-mentioned conventional valve lifter, however, when the number of the engine rotation increases or decreases suddenly, in particular at the start time of the engine, bubbles may be generated in the engine oil supplied to the reservoir chamber through both oil supply passages. If the bubbles are in excess in an upper portion of the reservoir chamber, the bubbles will enter into the pressure chamber from the reservoir chamber, whereby the stiffness of the valve lifter can be removed and striking noises can be generated.

SUMMARY OF THE INVENTION

One general object of the present invention, therefore, is to eliminate the drawbacks of a valve actuating device including the prior art hydraulic valve lifter.

More specifically, it is an object of the present invention to provide a valve actuating device which prevents bubbles from entering into a pressure chamber of the valve lifter by means o discharging outside the bubbles contained in the engine oil flowing through oil supply passages.

Another object of the present invention is to provide a new and improved valve actuating device which is simple in construction, economical to manufacture and thoroughly reliable in operation.

In one illustrative embodiment of the present invention, there is provided a valve actuating device which includes a hydraulic valve lifter disposed in a rocker arm, a hollow rocker shaft pivotally supporting the rocker arm, a first oil supply passage formed in the hollow rocker shaft, a second oil supply passage formed in the rocker arm for connecting the first oil supply passage with a reservoir chamber of the valve lifter, and an air hole formed in an upper portion of the hollow rocker shaft for connecting the interior thereof with the ambient atmosphere.

In accordance with one feature of the present invention, even if bubbles are contained in the oil supplied to the reservoir chamber, the bubbles can be discharged outside through the air hole to thereby prevent the bubbles from entering into the pressure chamber from the reserovir chamber.

In accordance with another feature of the present invention, since the air hole is formed in upper portion of the hollow rocker shaft, it is not always necessary to form a plurality of air holes in the rocker shaft even if the present invention is applied to an internal combustion engine wherein a plurality of hydraulic valve lifters are disposed on the rocker shaft.

The above noted as well as further objects and features of the invention will be understood more clearly and fully from the following detailed description of a preferred embodiment thereof, when read with reference to the accompanying drawings.

DETAILED DESCRIPTION OF THE PREFERRED EMBODIMENT

Figure 1:
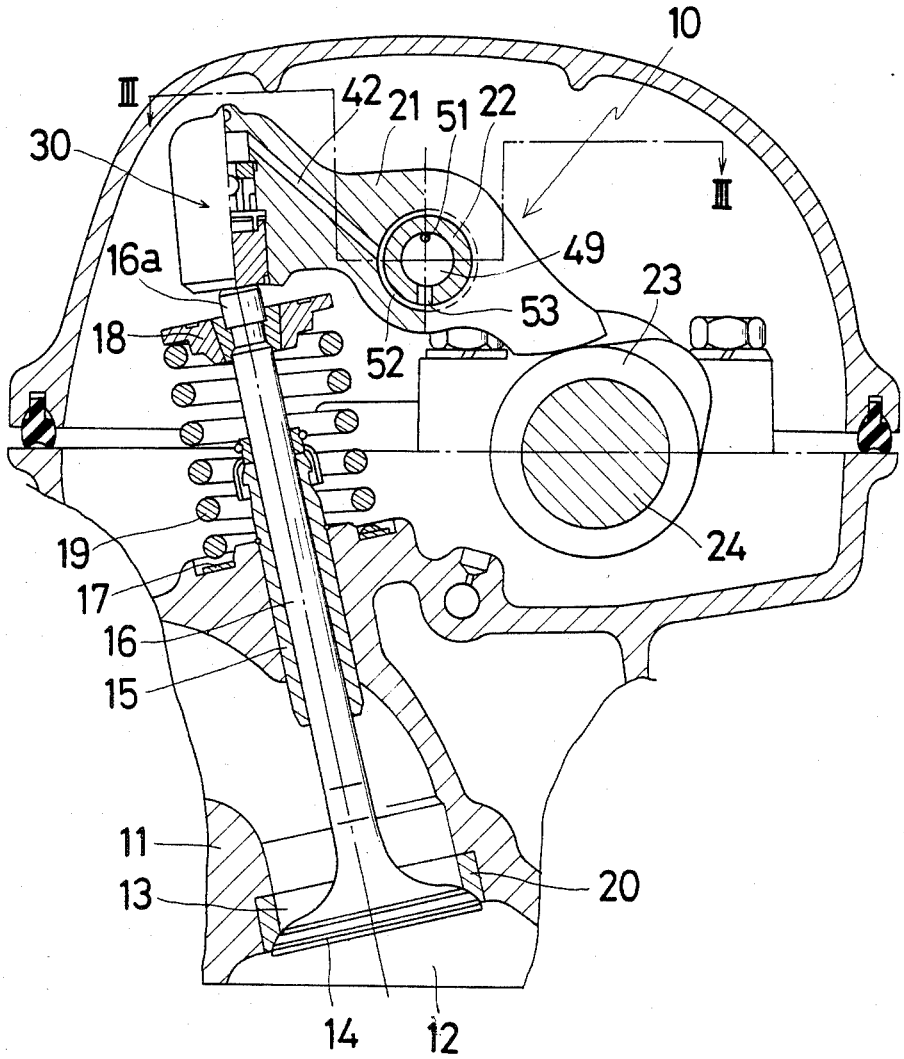
FIG. 1 is a sectional view of a valve actuating device for an internal combustion engine embodying the present invention.

Referring now to FIG. 1, there is shown a valve actuating device 10 for an overhead cam type internal combustion engine according to the present invention. A combustion chamber 12 is defined by a cylinder head 11 forming an upper end portion of an engine cylinder. A communication between the combustion chamber 12 and a cylinder head port 13 can be controlled to be opened and closed by an engine valve 14. Interposed in the cylinder head 11 is a valve guide member 15 in which a valve stem 16 is slidably inserted. The engine valve 14 is constantly biased toward a valve seat 20 by a valve spring 19 which is interposed between a spring retainer 17 fixed on the upper end surface of the cylinder head 11 and a spring retainer 18 fixed on the upper end of the valve stem 16.

A rocker arm 21, which is pivotally supported on a rocker arm shaft 22, receives at one end a load from the cam 23 and is operatively connected at the other end thereof with the valve stem 16 through a hydraulic valve lifter 30. The cam 23 is rotated with a cam shaft 24 by the rotation of a crank shaft. The engine valve 14 is actuated to be opened and closed by the rotation of the cam 23 through the rocker arm 21, the hydraulic valve lifter 30 and the valve stem 16.

Figure 2:
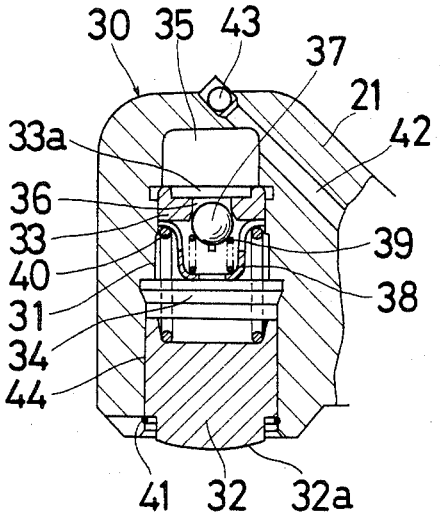
FIG. 2 is an enlarged sectional view of a hydraulic valve lifter shown in FIG. 1.

Next, the hydraulic valve lifter 30 is shown in greater detail in FIG. 2. The rocker arm 21 is provided with a cylinder 31 having an opened lower end. A plunger member 32 is slidably disposed in the cylinder 31 to thereby close the opened lower end of the cylinder 31. A lower end surface 32*a* of the plunger member 32 is in engagement with an upper end portion 16*a* of the valve stem 16 and is spherical so that the plunger member 32 may directly actuate the valve stem 16. The plunger member 32 has a simple column shape, and a normal solid pin is sufficient. For example, a roller of a roller bearing can be used as the plunger member 32.

Securely fixed in the inner wall of the cylinder 31 is a valve seat member 33 by which an interior of the cylinder 31 is divided into a pressure chamber 34 in the side of the plunger member 32 and a reservoir chamber 35 in the upper side. So as to make the manufacture cost low, the reservoir chamber 35 is processed from the direction in which the plunger member 32 is inserted. The valve seat member 33 is made of a wear resistant material and is provided at the center thereof with an axial hole 36 through which the pressure chamber 34 and the reservoir chamber 35 communicate with each other. At the same time, the valve seat member 33 is provided with a step portion 33*a* so as to enlarge the volume of reservoir chamber 35 and to differentiate the upper surface and the lower surface of the valve seat member on the assembly time. A ball check valve 37 is constantly biased upwardly shown in FIG. 2, namely toward a valve seat of the vave seat member 33, by means of a relatively light spring 39 supported by a cup-shaped retainer member 38 positioned in the pressure chamber 34. Therefore, the ball check valve 37 allows the flow of the fluid, such as engine oil, from the reservoir chamber 35 to the pressure chamber 34. Furthermore, in the pressure chamber 34 there is provided a plunger return spring 40 one end of which is supported by the retainer 38. The plunger member 32 is constantly biased downwardly shown in FIG. 2, namely toward the engagement with the valve stem 16 by the other end of the plunger return spring 40. The downward movement of the plunger member 32 is limited by a snap ring 41. The rocker arm 21 is provided with an oil supply passage 42 through which the engine oil is forcibly supplied to the reservoir chamber 35 from an external oil supply source such as an oil pump. The oil supply passage 42 is opened to an upper end portion of the reservoir chamber 35. Accodingly, the oil is prevented from flowing out from the reservoir chamber 35 during the engine stop, whereby the enough oil is securely preserved in the reservoir chamber 35. After the oil supply passage 42 is processed by machine in the direction of the rocker arm shaft 22 from an upper portion of the rocker arm 21, the upper portion of the rocker arm 21 is tightly closed by a plug 43.

Figure 3:
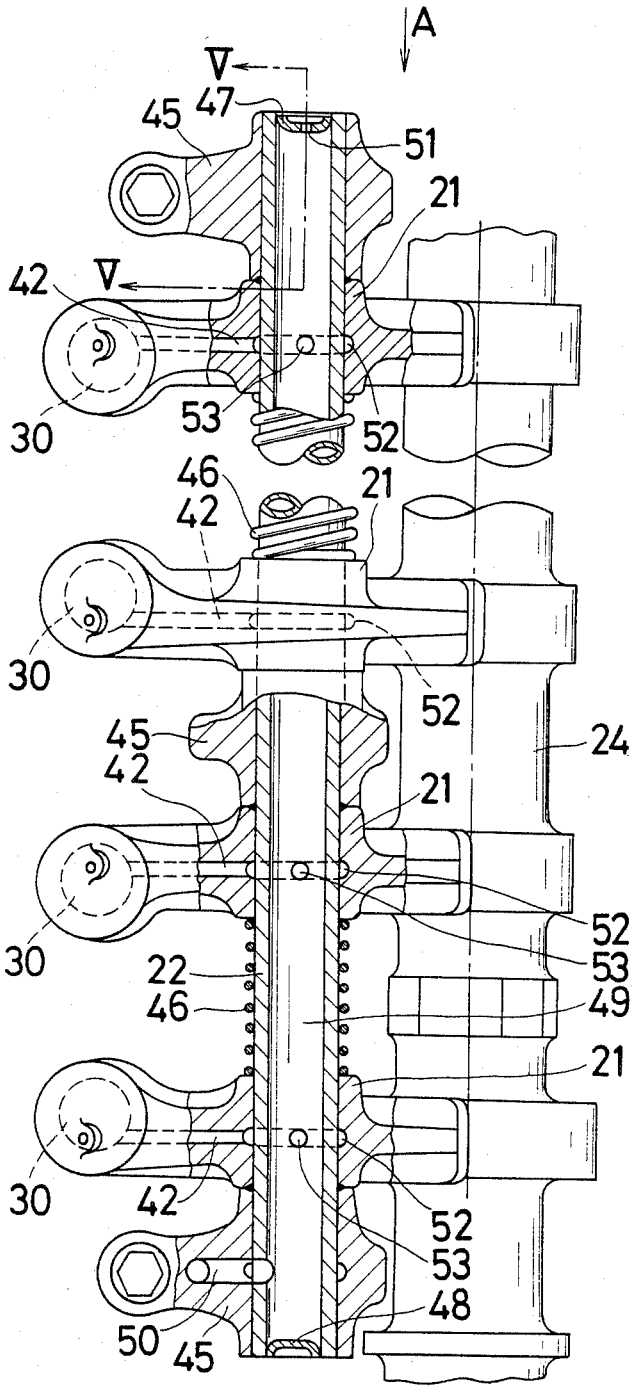
FIG. 3 is a partial sectional view taken approximately along section line III—III of FIG. 1.

As clearly indicated in FIG. 3, the rocker arm shaft 22 is fixedly supported by a plurality of rocker supports 45 fixed on a stationary portion of an engine. A plurality of, rocker arms 21 are pivotally supported on the rocker arm shaft 22. The hydraulic valve lifter 30 is disposed in each rocker arm 21, respectively. There are provided adjacent hydraulic valve lifters whose positions are decided by each spring 46 to the rocker support 45. One valve lifter is disposed in engagement with the valve stem 16 of the intake valve, while the other valve lifter is disposed in engagement with the valve stem 16 of the exhaust valve.

Each oil supply passage 42, which is formed in the rocker arm 21 and is connected with each reservoir chamber 35, communicates with an oil supply passage 49 formed in a hollow portion of the rocker arm shaft 22. Both ends of the oil supply passage 49 are tightly closed by plugs 47, 48. The oil supply passage 49 communicates with an oil source passage 50 formed in one of the rocker supports 45. The passage 50 is connected with the external oil supply source.

Figure 4:
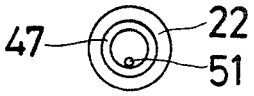
FIG. 4 is a view looking in the direction of arrow A of FIG. 3.

In the embodiment shown in FIG. 3, the plug 47 is provided with an air hole 51. Therefore, even if many bubbles are contained in the oil when the number of the engine revolutions is suddenly increased or decreased on the engine start, the bubbles are discharged outside from the air hole 51 to thereby prevent the bubbles from entering into the pressure chamber 34. It is preferable that the diameter of the air hole 51 is set to be smaller than that of the passage 50, whereby there is no loss of the oil supply. Moreover, the air hole 51 formed in the plug 47 is positioned in the upper portion of the hollow rocker arm shaft 22 as clearly shown in FIG. 1 and FIG. 4. The rocker arm 21 is provided with an annular oil passage 52 communicating with the oil supply passage 42 formed in the rocker arm 21. The annular passage 52 and the oil supply passage 49 formed in the hollow shaft 22 are connected by an oil hole 53 which is formed in the lower portion of the rocker arm shaft 22 and is positioned in the opposite side to the air hole 51. As a result, the bubbles contained in the oil of the oil supply passage 49 and preserved in the upper portion of the passage 49 can be discharged outside from the air hole 51.

In operation, the reservoir chamber 35 of the hydraulic valve lifter 30 receives a supply of hydraulic fluid, such as the lubricating oil of the engine, from the oil pump. When the engine started, the cam shaft 24 is rotated and the plunger member 32 is moved downwardly. As a result, the oil pressure within the pressure chamber 34 is increased and the check valve 37 is brought into contact with the valve seat member 33 to thereby close the axial hole 36. At this time oil flows out from the pressure chamber 34 through a leak clearance 44 between an inner wall surface of the cylinder 31 and an outer wall surface of the plunger member 32. Therefore, the plunger member 32 is moved upwardly with respect to the rocker arm 21 by a distance. When the cam shaft 24 is further rotated, the plunger member 32 is moved downwardly with respect to the rocker arm 21 by the distance by means of the biasing force of the plunger return spring 40. As a result, the oil pressure within the pressure chamber 34 is reduced and the check valve 37 separated from the valve seat member 33 to thereby open the axial hole 36. At this time oil is transmitted from the reservoir chamber 35 to the pressure chamber 34. Therefore, the valve lifter 30 is returned to its original length. Thus, the expansion and contraction by the above distance will be repeated continuously during the operation of the valve lifter 30.

If a clearance is produced in the valve operating mechanism due to thermal expansion of the crank case, the cylinder block, the cylinder head, or the like, the plunger member 32 will be moved downwardly by the plunger return spring 40 with respect to the rocker arm 21 in order that the clearance will become 0. On the other hand, when the valve operating mechanism is lengthened, the plunger member 32 is moved downwardly by the plunger return spring 40 from its condition in which the plunger member 32 is contracted so that the clearance will become 0.

In the above-mentioned embodiment, an air hole is formed in only the plug 47. It may be possible to form the air hole in both the plugs 47 and 48.

Figure 5:
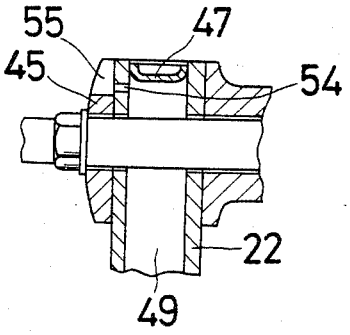
FIG. 5 is a sectional view showing a modification of the present invention and corresponding to a view taken approximately along section line V—V of FIG. 3 for convenience.

A modification of the present invention is illustrated in FIG. 5, wherein air holes 54 and 55 are formed in the rocker arm shaft 22 and the rocker support 45, respectively, instead of the plug 47. The air holes 54 and 55 are positioned in the upper portion of the rocker arm shaft 22.

The position in which plugs are formed is not limited to that shown in the above embodiment, and also a plurality of plugs may be formed. Though the hydraulic valve lifter is disposed in the rocker arm in the side of the valve stem according to the above embodiment, it may be possible to dispose the hydraulic valve fifter in the side of the cam shaft as indicated in the abovementioned Japanese published patent application No. 53-16122.

It should be understood that the preferred embodiment of the present invention has been described herein in considerable detail and that certain modifications, changes and adaptations may be made therein by those skilled in the art and that it is hereby intended to cover all modifications, changes and adaptation thereof falling within the scope of the appended claims.

What is claimed is:

1. A valve actuating device for an internal combustion engine having cam and a valve stem, said device comprising:

a rocker arm receiving a load from said cam at one end and actuating said valve stem at the other end thereof;

a hydraulic valve lifter disposed in said rocker arm, said valve lifter including a cylinder formed in said rocker arm, a plunger member disposed in said cylinder and engaging one of said valve stem and said cam at one end thereof, a pressure chamber defined by the other end of said plunger member, a reservoir chamber formed in said rocker arm and a check valve allowing the flow of hydraulic fluid between said pressure chamber and said reservoir; and a hollow rocker arm shaft pivotally supporting said rocker arm and having a first fluid supply passage therein, an air hole formed adjacent an upper portion of said hollow rocker arm shaft so as to communicate the interior of said hollow rocker arm shaft with the ambient atmosphere wherein said air hole is formed in a plug closing one end of said first fluid supply passage, and a fluid hole formed in said hollow rocker arm shaft on the side thereof opposite to said air hole;

said rocker arm being provided with an annular fluid passage which communicates with said first fluid supply passage through said fluid hole and a second fluid supply passage communicating said annular fluid passage with said reservoir chamber.

2. A valve actuating device as defined in claim 1 further comprising rocker supports mounted on a stationary portion of said engine for fixedly supporting said hollow rocker arm shaft and a fluid source passage formed in one of said rocker supports disposed in communication with said first fluid supply passage and adapted to be connected to an external fluid supply source wherein the diameter of said air hole is smaller than the diameter of said fluid source passage.

3. A valve actuating device as defined in claim 1 wherein said air hole is formed directly in said hollow rocker arm shaft.

* * * * *